US008253646B2

(12) United States Patent
Nakatani

(10) Patent No.: US 8,253,646 B2
(45) Date of Patent: Aug. 28, 2012

(54) ANTENNA

(75) Inventor: Koji Nakatani, Hiratsuka (JP)

(73) Assignee: The Yokohama Rubber Co., Ltd., Tokyo (JP)

( * ) Notice: Subject to any disclaimer, the term of this patent is extended or adjusted under 35 U.S.C. 154(b) by 0 days.

(21) Appl. No.: 13/393,058

(22) PCT Filed: Jun. 10, 2010

(86) PCT No.: PCT/JP2010/059813

§ 371 (c)(1),
(2), (4) Date: Feb. 28, 2012

(87) PCT Pub. No.: WO2011/027603

PCT Pub. Date: Mar. 10, 2011

(65) Prior Publication Data

US 2012/0154252 A1 Jun. 21, 2012

(30) Foreign Application Priority Data

Sep. 1, 2009 (JP) ..... 2009-201573

(51) Int. Cl.
*H01Q 1/36* (2006.01)
*H01Q 1/38* (2006.01)

(52) U.S. Cl. ..... 343/895; 343/700 MS

(58) Field of Classification Search ..... 343/895, 343/700 MS
See application file for complete search history.

(56) References Cited

U.S. PATENT DOCUMENTS

| | | | | |
|---|---|---|---|---|
| 7,236,141 | B2 * | 6/2007 | Huang | 343/895 |
| 7,324,063 | B2 * | 1/2008 | Bae et al. | 343/895 |
| 2003/0034867 | A1 | 2/2003 | Berthold et al. | |

FOREIGN PATENT DOCUMENTS

| | | | |
|---|---|---|---|
| JP | 61-030803 | A | 2/1986 |
| JP | 10-084214 | A | 3/1998 |
| JP | 2001-345628 | A | 12/2001 |
| JP | 2003-521114 | A | 7/2003 |
| JP | 2006-340186 | A | 12/2006 |
| JP | 2007-214927 | A | 8/2007 |

OTHER PUBLICATIONS

International Search Report of corresponding International Application No. PCT/JP2010/059813, dated on Sep. 14, 2010.

* cited by examiner

*Primary Examiner* — Jacob Y Choi
*Assistant Examiner* — Hasan Islam
(74) *Attorney, Agent, or Firm* — Global IP Counselors, LLP

(57) ABSTRACT

An antenna including first and second printed wiring boards and a plurality of linking conductors. The first and second printed wiring boards each has a respective plurality of rectilinear printed wiring patterns arranged in parallel at a specified interval, and respective through holes formed on both ends of each of the respective rectilinear printed wiring patterns. The plurality of linking conductors are configured so that both ends of the conductors are linked to the through holes that are formed in the first and second printed wiring boards so that the first printed wiring board and the second printed wiring board are disposed opposite each other, and so that the plurality of rectilinear printed wiring patterns formed on the first printed wiring board and the plurality of rectilinear printed wiring patterns formed on the second printed wiring board are conductively connected to each other in a helix.

5 Claims, 6 Drawing Sheets

ANTENNA

CROSS-REFERENCE TO RELATED APPLICATIONS

This U.S. National stage application claims priority under 35 U.S.C. §119(a) to Japanese Patent Application No. 2009-201573, filed in Japan on Sep. 1, 2009, the entire contents of Japanese Patent Application No. 2009-201573 are hereby incorporated herein by reference.

BACKGROUND

1. Field of the Invention

The present invention relates to an antenna, and particularly relates to a coil-shaped helical antenna.

2. Background Information

Conventionally, when helical antennas are produced, the same method is used as the one employed with springs to fashion copper wire or another metal material into a helically bent shape. Springs have poor shape retention when merely bent into shape, and are therefore usually hardened at high temperatures.

Such coil-shaped helical antennas are effectively used as small antennas, as disclosed, for example, in Japanese Laid-open Patent Publication Nos. 2001-345628 and 2006-340186.

SUMMARY

In terms of producing antennas, however, springs have poor shape retention when merely bent into shape, and are therefore usually hardened at high temperatures, as described above. The accuracy (for example, ±20 μm) required to satisfy the performance of a small antenna is therefore particularly difficult to achieve by contracting or otherwise working materials by hardening. The term "accuracy" used herein refers to an accuracy that ensures a VSWR of 2 or less.

For example, in a case in which a ten-turn, coil-shaped antenna 1 such as the one shown in FIG. 5 is produced having a matching frequency of 315 MHz and a matching input impedance of 50Ω, the dimensions prior to hardening are a coil diameter D of 12.500 mm, a coil length H of 12.442 mm, and a feeder length L of 38 mm, and the input impedance characteristic is at point A1 on the Smith chart shown in FIG. 6. However, the coil dimensions after hardening are changed by the contraction of the conductor. The accuracy in the case of a coil-shaped antenna produced by hardening is usually ±250 μm.

When the VSWR is greater than two in this case, for example, in a case in which the length H of the coil-shaped antenna 1 exceeds ±20 μm, the input impedance of the antenna 1 changes greatly, causing the antenna characteristics to deteriorate. Specifically, the input impedance characteristic of the antenna 1 when the length H of the antenna changes to 12.422 mm (VSWR=2) due to hardening is at point B1 on the Smith chart shown in FIG. 6, and the input impedance characteristic of the antenna 1 when the length H of the antenna changes to 12.462 mm (VSWR=2) due to hardening is at point B2 on the Smith chart shown in FIG. 6. The electrical power/VSWR characteristic in these cases is as shown in FIG. 7. For example, a 44% power loss occurs when the input impedance of the antenna 1 changes to 10Ω due to conductor contraction. This is in contrast to fact that the optimum input impedance value of the antenna 1 is 50Ω. In FIG. 7, the vertical axis indicates the input electrical power (Pin)/output electrical power (Pout) and the VSWR, the horizontal axis indicates the input impedance, P indicates the Pin/Pout characteristic curve, and S indicates the VSWR characteristic curve.

An object of the present invention, which was devised in view of the aforementioned problems, is to provide a coil-shaped antenna in which errors at the time of manufacture can be reduced.

In view of the aforementioned problems, the present invention provides an antenna comprising a first printed wiring board provided with a plurality of rectilinear printed wiring patterns arranged in parallel at a specified interval, and through holes formed on both ends of each of the rectilinear printed wiring patterns; a second printed wiring board provided with a plurality of rectilinear printed wiring patterns arranged in parallel at a specified interval, and through holes formed on both ends of each of the rectilinear printed wiring patterns; and a plurality of linking conductors provided so that both ends of the conductors are linked to the through holes that are formed in the first and second printed wiring boards so that the first printed wiring board and the second printed wiring board are disposed opposite each other, and provided so that the plurality of rectilinear printed wiring patterns formed on the first printed wiring board and the plurality of rectilinear printed wiring patterns formed on the second printed wiring board are conductively connected to each other in a helix.

According to the present invention, rectilinear printed wiring patterns formed on two printed boards are conductively connected to each other in a helix by linking conductors, and a helical antenna is formed by the rectilinear printed wiring patterns and the linking conductors.

The present invention is configured so that rectilinear printed wiring patterns for constructing an antenna element are produced on two printed wiring boards using a conductive pattern, and through-hole conductors and linking conductors provided to the first and second printed wiring boards are conductively connected in sequence to each other to produce a helical antenna element in the conductive pattern on the first and second printed wiring boards. Antennas having dimensional accuracy of the printed wiring patterns and dimensional accuracy (for example, ±18 μm) of the linking conductors can therefore be manufactured, allowing high-performance antennas to be readily manufactured.

DETAILED DESCRIPTION OF EMBODIMENTS

An embodiment according to the present invention will be described hereinafter with reference to the drawings.

Figure 1:
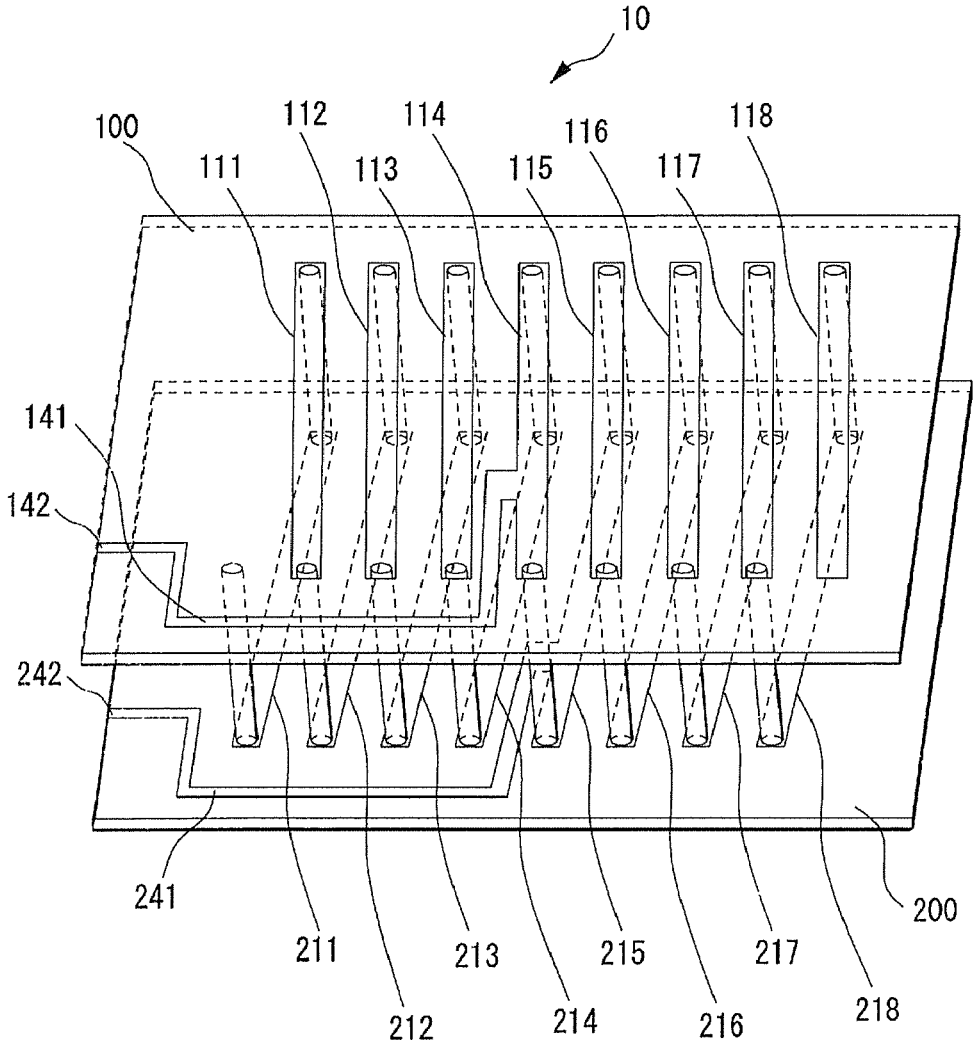
FIG. 1 is an external perspective view showing an antenna in an embodiment according to the present invention.
Figure 2:
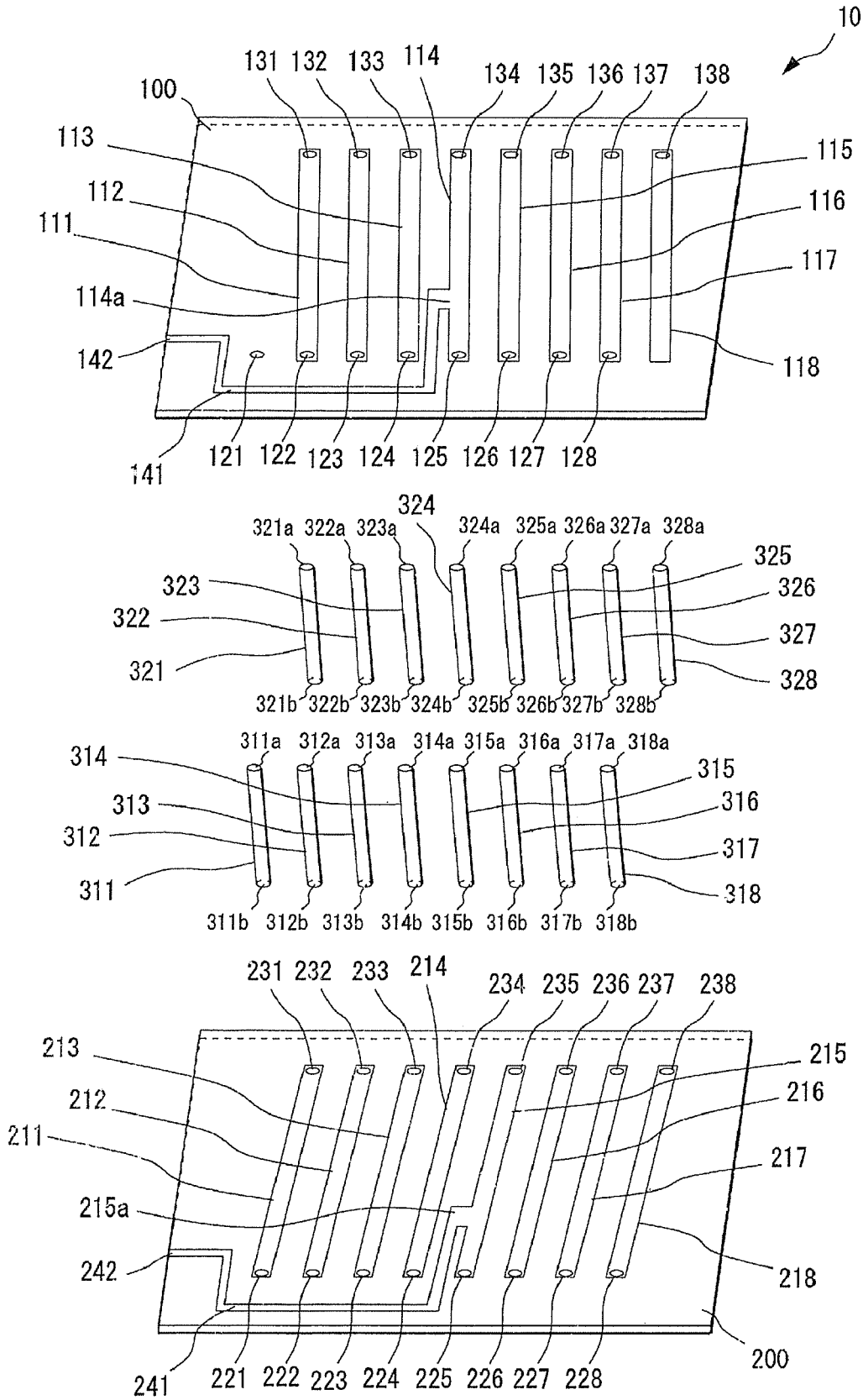
FIG. 2 is an exploded perspective view showing an antenna in an embodiment according to the present invention.
Figure 3:
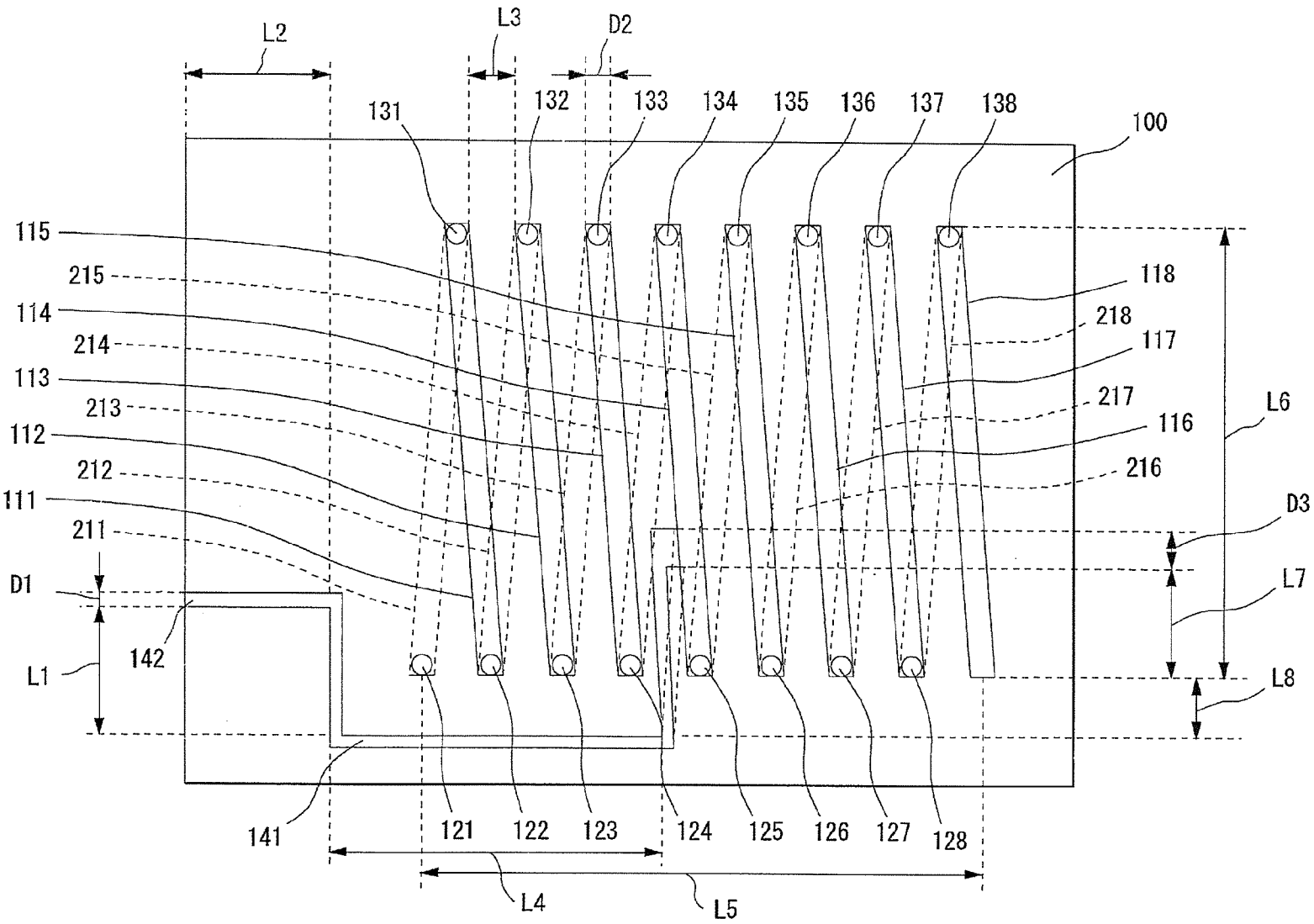
FIG. 3 is a planar perspective view showing an antenna in an embodiment according to the present invention.

FIG. 1 is an external perspective view of an antenna in an embodiment according to the present invention, FIG. 2 is an exploded perspective view of FIG. 1, and FIG. 3 is a planar perspective view of FIG. 1. In the drawings, 10 is an antenna comprising first and second printed wiring boards 100, 200 and a plurality of cylindrical linking conductors 311 to 318, 321 to 328. The antenna 10 in the present embodiment has a resonance frequency of 315 MHz, which is the same as in conventional examples.

The first printed wiring board 100 has a rectangular shape having a specified area. The wiring board comprises a dielectric substrate having a specified thickness, and a plurality of through holes 121 to 128, 131 to 138 are provided along both widthwise lateral edges at specified regular intervals L3 from each other in a straight line parallel to the long side of the board. The through holes 131 to 138 on one lateral edge are provided so that each of the through holes is disposed at a position opposite to a position substantially in the center of each of the gaps between the through holes 121 to 128 provided on the other lateral edge, as shown in FIG. 3.

A plurality of rectilinear printed wiring patterns (hereinafter referred to as "wiring patterns") 111 to 118 disposed parallel to each other at specified intervals L3 from each other are provided to the front surface of the first printed wiring board 100. The lengthwise width of the first printed wiring board 100 in each of the wiring patterns 111 to 118 is set to D2, and the length in the direction of the short side is set to L6.

One end of the wiring pattern 111 is linked to the second through hole 122, as counted from the end in the one row of through holes 121 to 128, and the other end is linked to the through hole 131 positioned at the end in the other row of through holes 131 to 138. One end of the wiring pattern 112 is linked to the third through hole 123, as counted from the end in the one row of through holes 121 to 128, and the other end is linked to the through hole 132 positioned second from the end in the other row of through holes 131 to 138. One end of the wiring pattern 113 is linked to the fourth through hole 124, as counted from the end in the one row of through holes 121 to 128, and the other end is linked to the through hole 133 positioned third from the end in the other row of through holes 131 to 138. One end of the wiring pattern 114 is linked to the fifth through hole 125, as counted from the end in the one row of through holes 121 to 128, and the other end is linked to the through hole 134 positioned fourth from the end in the other row of through holes 131 to 138. One end of the wiring pattern 115 is linked to the sixth through hole 126, as counted from the end in the one row of through holes 121 to 128, and the other end is linked to the through hole 135 positioned fifth from the end in the other row of through holes 131 to 138. One end of the wiring pattern 116 is linked to the seventh through hole 127, as counted from the end in the one row of through holes 121 to 128, and the other end is linked to the through hole 136 positioned sixth from the end in the other row of through holes 131 to 138. One end of the wiring pattern 117 is linked to the eighth through hole 128, as counted from the end in the one row of through holes 121 to 128, and the other end is linked to the through hole 137 positioned seventh from the end in the other row of through holes 131 to 138. One end of the wiring pattern 118 is disposed at a position located at a distance of one interval L3 from one end of the wiring pattern 117, and the other end is linked to the through hole 138 positioned eighth from the end in the other row of through holes 131 to 138. The distance between the first through hole 121, as counted from the end, and one end of the eighth wiring pattern 118 is set to L5, as shown in FIG. 3.

A feed point 114*a* is set at a specified position on the fourth wiring pattern 114, as counted from the end, and one end of a power feeder wiring pattern 141 is conductively connected to the feed point. The other end 142 of the power feeder wiring pattern 141 is provided so as to reach one short side of the first printed wiring board 100, as shown in the drawing. The width of the power feeder wiring pattern 141 at the feed point 114*a* is set to D3, as shown in FIG. 3. Furthermore, the power feeder wiring pattern 141 is disposed so as to extend in the direction of the short side of the first printed wiring board 100, and the pattern is bent 90° to the right at a position located at a distance L8 from one end of the wiring pattern 114, is extended over a distance L4 in the direction of the first through hole 121, is bent 90° to the right, is extended over a distance L1, is bent 90° to the left, and is made to reach the short side of the first printed wiring board 100 at a position extended over a distance L2. The width of the power feeder wiring pattern 141 is set to D1.

The second printed wiring board 200 has the same shape as the first printed wiring board 100, and is provided with a plurality of through holes 221 to 228, 231 to 238 along both widthwise lateral edges at specified regular intervals L3 from each other in a straight line parallel to the long side of the board. The positions of the through holes 221 to 228, 231 to 238 correspond to the positions of the through holes 121 to 128, 131 to 138 in the first printed wiring board 100.

A plurality of rectilinear printed wiring patterns (hereinafter referred to as "wiring patterns") 211 to 218 disposed parallel to each other at regular intervals L3 from each other are provided to the front surface of the second printed wiring board 200. The lengthwise width of the second printed wiring board 200 in each of the wiring patterns 211 to 218 is set to D2, and the length in the direction of the short side is set to L6.

One end of the wiring pattern 211 is linked to the first through hole 221, as counted from the end in the one row of through holes 221 to 228, and the other end is linked to the through hole 231 positioned at the end in the other row of through holes 231 to 238. One end of the wiring pattern 212 is linked to the second through hole 222, as counted from the end in the one row of through holes 221 to 228, and the other end is linked to the through hole 232 positioned second from the end in the other row of through holes 231 to 238. One end of the wiring pattern 213 is linked to the third through hole 223, as counted from the end in the one row of through holes 221 to 228, and the other end is linked to the through hole 233 positioned third from the end in the other row of through holes 231 to 238. One end of the wiring pattern 214 is linked to the fourth through hole 224, as counted from the end in the one row of through holes 221 to 228, and the other end is linked to the through hole 234 positioned fourth from the end in the other row of through holes 231 to 238. One end of the wiring pattern 215 is linked to the fifth through hole 225, as counted from the end in the one row of through holes 221 to 228, and the other end is linked to the through hole 235 positioned fifth from the end in the other row of through holes 231 to 238. One end of the wiring pattern 216 is linked to the sixth through hole 226, as counted from the end in the one row of through holes 221 to 228, and the other end is linked to the through hole 236 positioned sixth from the end in the other row of through holes 231 to 238. One end of the wiring pattern 217 is linked to the seventh through hole 227, as counted from the end in the one row of through holes 221 to 228, and the other end is linked to the through hole 237 positioned seventh from the end in the other row of through holes 231 to 238. One end of the wiring pattern 218 is linked to the eighth through hole 228, as counted from the end in the one row of through holes 221 to 228, and the other end is linked to the through hole 238 positioned eighth from the end in the other row of through holes 231 to 238.

A feed point 215*a* is set at a specified position on the fifth wiring pattern 215, as counted from the end, and one end of a power feeder wiring pattern 241 is conductively connected to the feed point. The position of the feed point 215*a* is set opposite the feed point 114*a* of the wiring pattern 114 on the first printed wiring board 100.

The other end 242 of the power feeder wiring pattern 241 is provided so as to reach one short side of the second printed wiring board 200, as shown in FIG. 2. The power feeder wiring pattern 241 is formed in the same shape so as to be opposite the power feeder wiring pattern 141 formed on the first printed wiring board 100, as shown in FIG. 3. The width of the power feeder wiring pattern 241 at the feed point 215*a* is set to D3, and the power feeder wiring pattern 241 is disposed so as to extend in the direction of the short side of the second printed wiring board 200, in the same manner as the first printed wiring board 100. The wiring pattern is bent 90° to the right at a position located at a distance L8 from one end of the wiring pattern 214, is extended over a distance L4 in the direction of the first through hole 221, is bent 90° to the right, is extended over a distance L1, is bent 90° to the left, and is made to reach the short side of the second printed wiring board 200 at a position extended over a distance L2. The width of the power feeder wiring pattern 241 is set to D1.

The wiring patterns 111 to 118 of the first printed wiring board 100 and the wiring patterns 211 to 218 of the second printed wiring board 200 are conductively connected to each other by a plurality of linking conductors 311 to 318, 321 to 328 to collectively form a helix. Cylindrical conductors having a diameter of 0.75 mm and a length of 8.0 mm are used as the linking conductors 311 to 318, 321 to 328 in the present embodiment.

Specifically, the corresponding ends 311*a* to 318*a* of the linking conductors 311 to 318 are inserted and fixed in the through holes 121 to 128 of the first printed wiring board 100, and the corresponding ends 312*a* to 318*a* of the linking conductors 312 to 318 are conductively connected to one end of each of the wiring patterns 111 to 117. The other corresponding ends 311*b* to 318*b* of the linking conductors 311 to 318 are inserted and fixed in the through holes 221 to 228 of the second printed wiring board 200, and the other corresponding ends 311*b* to 318*b* of the linking conductors 311 to 318 are conductively connected to one end of each of the wiring patterns 211 to 218. The corresponding ends 321*a* to 328*a* of the linking conductors 321 to 328 are inserted and fixed in the through holes 131 to 138 of the first printed wiring board 100, and the corresponding ends 321*a* to 328*a* of the linking conductors 321 to 328 are conductively connected to the other ends of the wiring patterns 111 to 118. The corresponding other ends 321*b* to 328*b* of the linking conductors 321 to 328 are inserted and fixed in the through holes 231 to 238 of the second printed wiring board 200, and the corresponding other ends 321*b* to 328*b* of the linking conductors 321 to 328 are conductively connected to the other ends of the wiring patterns 211 to 218.

The following dimensions may, for example, be set in the present embodiment: L1=5.0 mm, L2=5.0 mm, L3=1.726 mm, L4=12.9 mm, L5=21.81 mm, L6=17.75 mm, L7=4.375 mm, L8=2.3 mm, D1=0.5 mm, D2=1.0 mm, D3=1.5 mm.

According to the aforedescribed embodiment, an antenna element is formed on the two printed wiring boards 100, 200 by the electroconductive wiring patterns 111 to 118, 211 to 218, and the wiring patterns 111 to 118, 211 to 218 are conductively connected in an alternating sequence by the linking conductors 311 to 318, 321 to 328 to form a helical antenna element. Antennas having the dimensional accuracy of the printed wiring patterns 111 to 118, 211 to 218 and the dimensional accuracy (for example, ±18 μm) of the linking conductors 311 to 318, 321 to 328 can thereby be manufactured, and high-performance antennas can be readily manufactured. Furthermore, excellent reliability in electrical connection to the printed wiring boards can be achieved together with the ease of mass production, allowing antennas having excellent dimensional accuracy to be readily manufactured.

Figure 4:
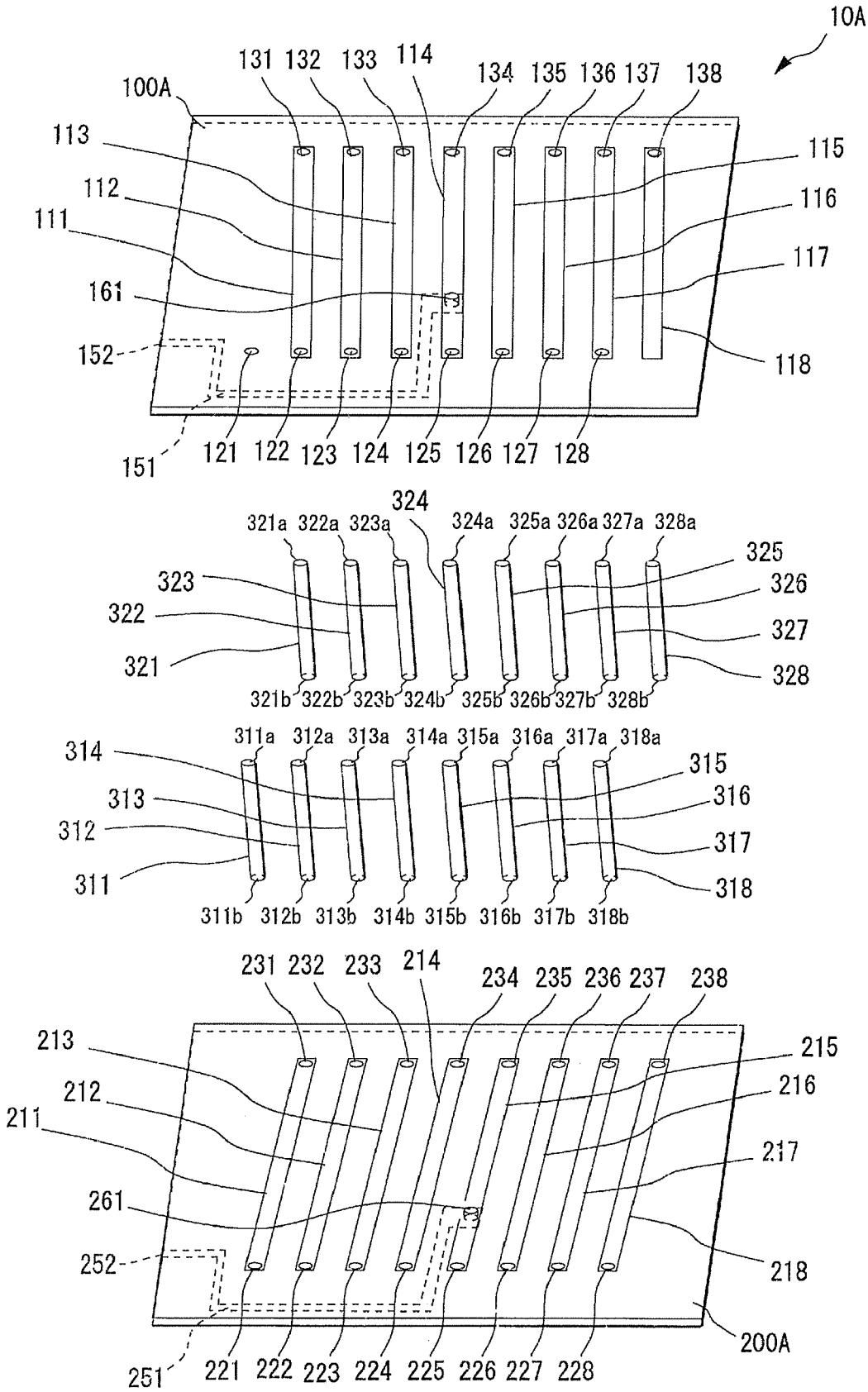
FIG. 4 is an exploded perspective view showing another configurational example of an antenna in an embodiment according to the present invention.
Figure 5:
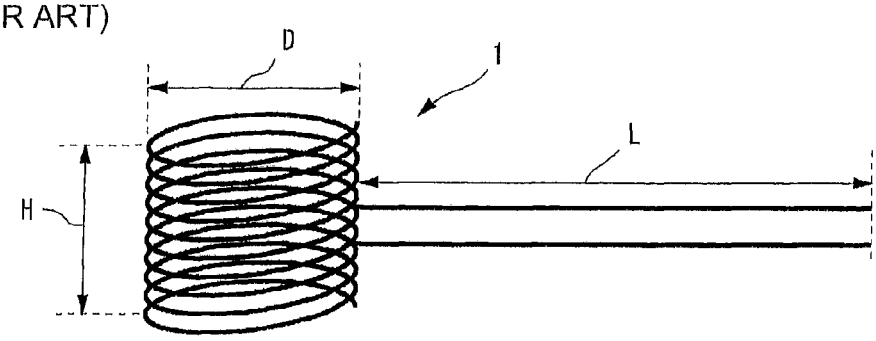
FIG. 5 (PRIOR ART)
FIG. 5 is an external perspective view showing an antenna according to a conventional example.
Figure 6:
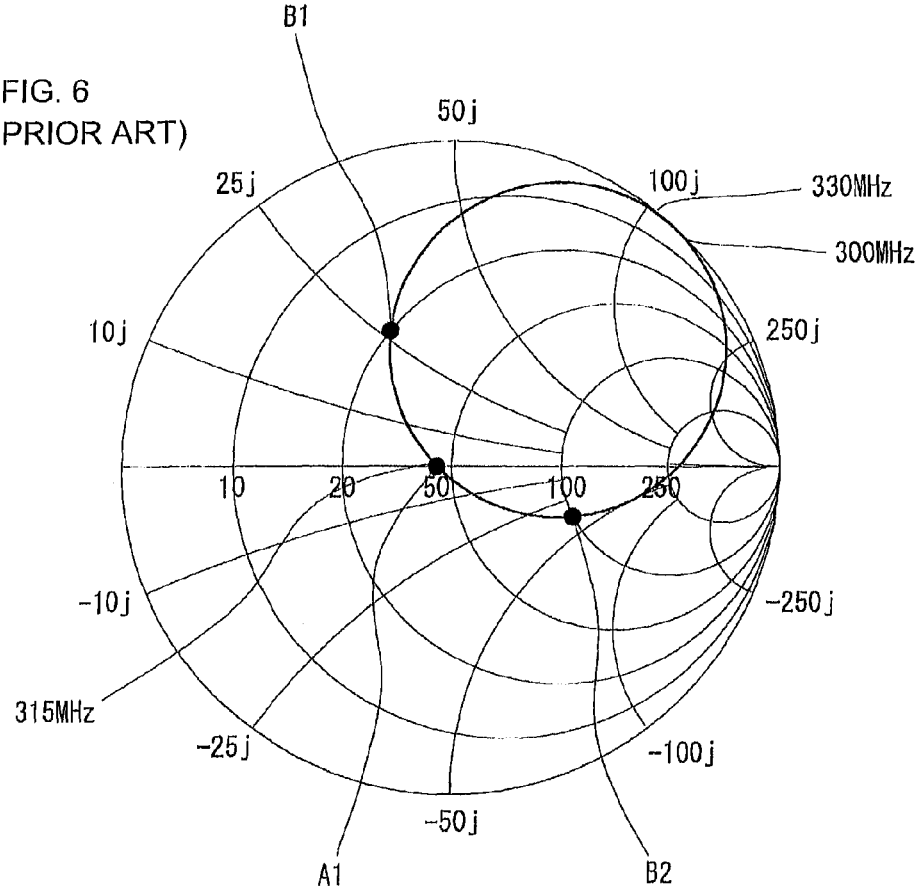
FIG. 6 (PRIOR ART)
FIG. 6 is a Smith chart describing the impedance characteristic of an antenna according to a conventional example.
Figure 7:
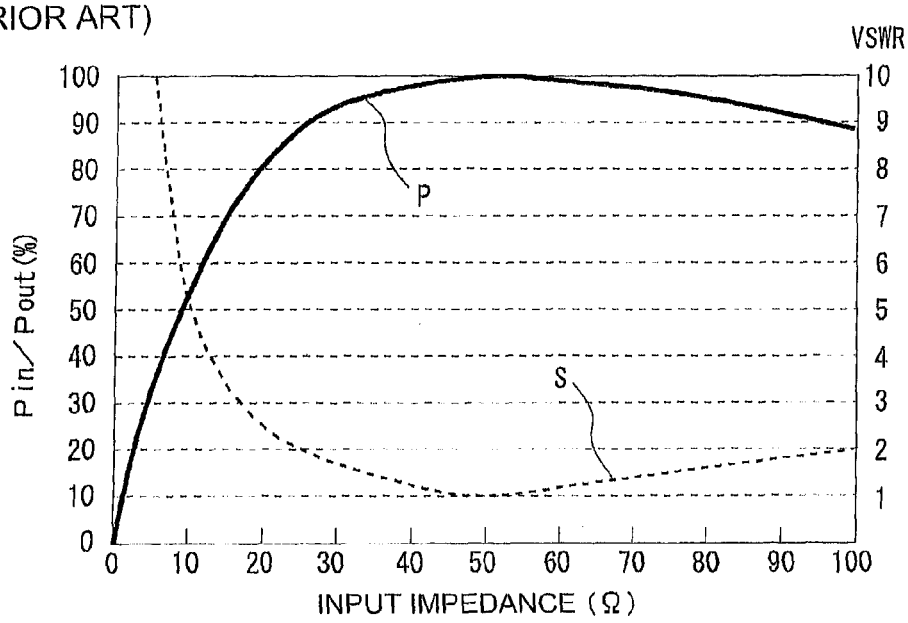
FIG. 7 (PRIOR ART)
FIG. 7 is a view showing the relationship between the impedance and the electric power/VSWR of an antenna according to a conventional example.

In the aforedescribed embodiment, the power feeder wiring patterns 141, 241 are provided to the same surface as the wiring patterns 111 to 118, 211 to 218, but the wiring patterns 111 to 118, 211 to 218 may be provided to the front surface of the printed wiring boards 100, 200, the power feeder wiring patterns 151 and 251 having ends 152 and 252, respectively, may be provided to the rear surface of the printed wiring boards 100, 200, and the patterns may be conductively connected by through-hole conductors 161, 261, as in the antenna 10A shown in FIG. 4. In addition, the antenna is configured having the feed point in the middle part of the coil in the present embodiment, but it is apparent that the same effect as above can also be achieved in a case in which the antenna is configured with a feed point at the end part of the coil.

The invention claimed is:

1. An antenna comprising:

a first printed wiring board having a plurality of rectilinear printed wiring patterns arranged in parallel at a specified interval, and through holes formed on both ends of each of the rectilinear printed wiring patterns;

a second printed wiring board having a plurality of rectilinear printed wiring patterns arranged in parallel at a specified interval, and through holes formed on both ends of each of the rectilinear printed wiring patterns; and a plurality of linking conductors configured so that both ends of the conductors are linked to the through holes that are formed in the first and second printed wiring boards so that the first printed wiring board and the second printed wiring board are disposed opposite each other, and further configured so that the plurality of rectilinear printed wiring patterns formed on the first printed wiring board and the plurality of rectilinear printed wiring patterns formed on the second printed wiring board are conductively connected to each other in a helix;

wherein the rectilinear printed wiring patterns are disposed at a front surface of the first and second printed wiring boards, a wiring pattern comprising a feeder part is disposed at a rear surface, and the wiring pattern comprising the feeder part on the rear surface is conductively connected to a specified position of the rectilinear printed wiring pattern on the front surface by a through-hole conductor.

2. The antenna according to claim 1 wherein a feed point having a specified impedance is provided at a specified position that is between one end and the other end of a coil comprising the plurality of rectilinear printed wiring patterns of the first and second printed wiring boards and between the plurality of linking conductors.

3. The antenna according to claim 1, wherein a first feed point having a first specified impedance is provided at a first specified position that is between one end and the other end of a coil comprising the plurality of rectilinear printed wiring patterns of the first printed wiring board; and a second feed point having a second specified impedance is provided at a second specified position that is between one end and the other end of a coil comprising the plurality of rectilinear printed wiring patterns of the second printed wiring board.

4. The antenna according to claim 1, wherein each of the rectilinear printed wiring patterns of the first printed wiring board extends transverse to each of the rectilinear printed wiring patterns of the second printed wiring board.

5. The antenna according to claim 1, wherein each of a group of the through holes of the first printed wiring board is linked by a respective one of the linking conductors to a respective one of the through holes of the second printed wiring board.

* * * * *